US005924810A

United States Patent [19]

Rukan et al.

[11] Patent Number: 5,924,810

[45] Date of Patent: Jul. 20, 1999

[54] DOUBLE SEAL SYSTEM FOR PRESSURIZED WRITING DEVICE

[75] Inventors: Ronald Stephen Rukan; Barry W. Chadwick, both of Simpsonville, S.C.

[73] Assignee: BIC Corporation, Milford, Conn.

[21] Appl. No.: 08/964,790

[22] Filed: Nov. 5, 1997

[51] Int. Cl.[6] ..... B43K 7/00

[52] U.S. Cl. ..... 401/209; 401/190

[58] Field of Search ..... 401/209, 190, 401/208, 217, 221, 143, 142

[56] References Cited

U.S. PATENT DOCUMENTS

| | | | |
|---|---|---|---|
| 2,519,341 | 8/1950 | Barstow . | |
| 3,130,711 | 4/1964 | Eckerlé . | |
| 3,420,610 | 1/1969 | Malm . | |
| 3,659,951 | 5/1972 | Germann . | |
| 3,775,015 | 11/1973 | Tsunoda et al. | 401/190 |
| 4,587,999 | 5/1986 | Boiko et al. | 401/190 |
| 5,242,234 | 9/1993 | Ahrens . | |
| 5,628,576 | 5/1997 | Smith . | |
| 5,738,459 | 4/1998 | Smith | 401/190 |

FOREIGN PATENT DOCUMENTS

| | | |
|---|---|---|
| 577.460 | 6/1924 | France . |
| 1.004.708 | 11/1951 | France . |
| 1.02.454 | 12/1952 | France . |
| 1.304.160 | 8/1962 | France . |
| 2532628 | 3/1984 | France . |
| 378349 | 7/1923 | Germany . |
| 898 867 | 12/1953 | Germany . |
| 1482-822 A1 | 9/1987 | U.S.S.R. . |
| 1831441 A3 | 7/1993 | U.S.S.R. . |
| 471612 | 9/1937 | United Kingdom . |
| 476971 | 12/1937 | United Kingdom . |

*Primary Examiner*—David J. Walczak
*Attorney, Agent, or Firm*—Pennie & Edmonds LLP

[57] ABSTRACT

A writing device generally including a uniformly cylindrical main body partially filled with a writing medium such as ink. A writing tip is inserted into a first end of the main body and a first sealing member is inserted into the second end thereof. The first sealing member is located in the main body near the second end. A pressurized gas such as nitrogen is disposed in the body between the ink and the first sealing member. Alternatively, a gas forming system may be provided in the main body to continually produce a gas as the ink is depleted to maintain pressure therein. A second sealing member is inserted into the second end of the main body to provide a dual seal gas pressurized system.

15 Claims, 2 Drawing Sheets

DOUBLE SEAL SYSTEM FOR PRESSURIZED WRITING DEVICE

TECHNICAL FIELD

The present invention relates generally to pressurized writing devices and more specifically to gas pressurized writing devices.

BACKGROUND OF THE INVENTION

Pressurized writing instruments have been in use for many years. Pressurized devices were incorporated into writing instruments to improve and maintain continuous ink flow to the tips of the writing instruments during operation of the instruments for extended periods in horizontal and upside down positions. Moreover, the use of pressurized devices in writing instruments has reduced the need to vigorously shake the instrument to initiate ink flow after mere storage of a partly empty pen or cartridge in an inverted position.

Pressurized systems have been used to minimize solvent loss in writing instruments which employ highly volatile solvents and in applications which employ high viscosity inks wherein pressure is needed to force the flow of ink to the writing tip.

Mechanical and chemical pressurizing devices are two types of pressurizing systems which have been employed in writing instruments. Mechanical pressurizing devices contain a mechanism such as a spring to maintain constant pressure on the writing medium as consumption of the writing medium proceeds. Gas pressurized systems produce a pressurized gas such as nitrogen through chemical reactions, fermentation and the like, to maintain pressure on the writing medium for continuous supply of the medium to the point or nib of the writing instrument.

U.S. Pat. No. 3,130,711 to Eckerle discloses a positive pressure ball point pen which employs a gas pressurized system to maintain pressure on the writing medium in the pen. Pressure is maintained as the result of an electrolytic action between dissimilar metals (metals having different positions in the electromotive series of metals) within the pen or cartridge. The container body or cartridge is formed of a metal such as brass and portions of the inner surface thereof are coated with a different metal such as zinc. The zinc layer is coated with an insulative protective layer which is insoluble in the writing medium (ink) but soluble in the hydrocarbon grease plug which acts as an ink follower. A body of fluid electrolyte is disposed behind the hydrocarbon grease plug and contacts the dissimilar electrode metals as the ink becomes depleted. A gas is produced as the metals come into contact with the electrolyte. Hence, the pressure is maintained as the ink is consumed. A rubber plug is inserted into the end of the container to seal the system from the outside atmosphere and prevent leakage thereof.

Although plug members as described above are used in gas pressurized systems to maintain a seal on the writing instrument and prevent leakage of the gas from the system, poor seals often result from the inability to hermetically seal a plug within the writing instrument. This is difficult to do in gas pressurized systems which prevent the use of certain bonding techniques due to the potential interaction or exposure of the bonding material or solvent with the gas. In an effort to provide more effective sealing, liquid sealants have been used in conjunction with plug members to maintain the integrity of the gas seal. This combination often produces internal pressure variations which interfere with the uniform flow of the writing medium.

There remains a need for a writing device in which the internal pressure is maintained throughout the entire life of the writing device without overly complex or expensive seals to allow for smooth and continuous flow of ink regardless of the orientation of the writing device. It is desirable to provide a gas pressurized writing device having a tight seal whereby gas is not lost to the atmosphere.

SUMMARY OF THE INVENTION

These and other objects and advantages are accomplished in a writing device generally including a uniformly cylindrical main body partially filled with a writing medium such as ink. A writing tip is inserted into a first end of the main body and a first sealing member is inserted into the second end thereof. The first sealing member is located in the main body near the second end. A pressurized gas such as nitrogen is disposed in the body between the ink and the first sealing member. Alternatively, a gas forming means may be located in the main body to continually produce a gas as the ink is depleted to maintain pressure therein. A second sealing member is located between the first sealing member and a second end of the main body.

BRIEF DESCRIPTION OF THE DRAWINGS

Features of the present invention are disclosed in the accompanying drawings, wherein similar reference characters denote similar elements throughout the several views, and wherein.

DETAILED DESCRIPTION OF THE INVENTION

Figure 1:
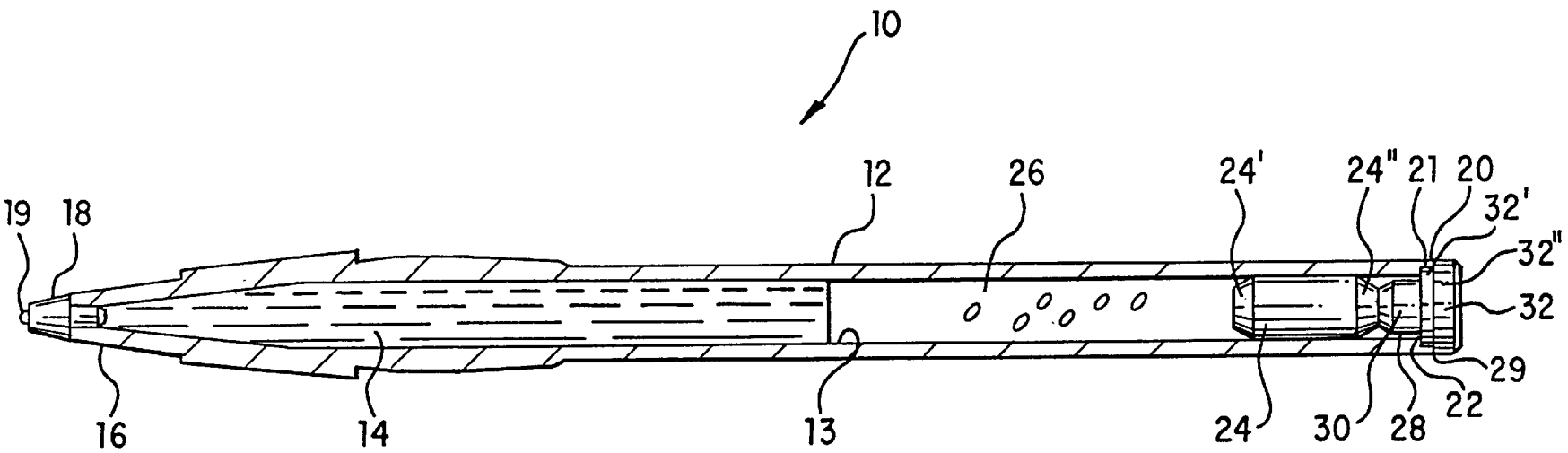
FIG. 1 is a cross-sectional view along the longitudinal axis of the writing device of the present invention.
Figure 2:
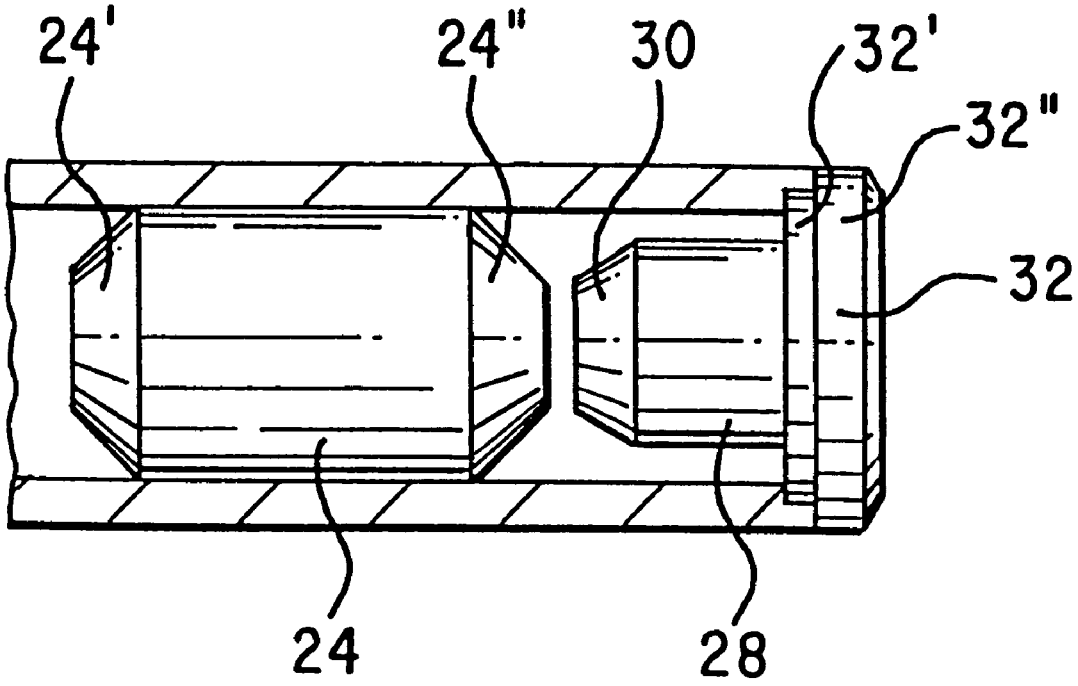
FIG. 2 is an enlarged view of the sealing members shown in FIG. 1.

Turning to FIG. 1, an embodiment of a writing device 10 constructed in accordance with the present invention is shown with the understanding that those of ordinary skill in the art will recognize many modifications and substitutions which may be made to various elements. writing device 10 generally includes a main body 12 partially filled with ink 14. Writing device 10 may be used independently as a writing instrument or may be inserted as a cartridge into a barrel or writing implement housing. Body 12 may primarily be formed of a rigid polymer or plastic material such as nylon, acrylonitrile, butadiene, styrene terpolymer, or the like. Main body 12 is substantially and uniformly cylindrical along the length of its interior wall 13 and tapers towards a first end 16. A point or nib 18 is formed on first end 16 through which an ink tip 19 is positioned. At a second end 20 opposite first end 16 is an opening 22 through which a first or primary sealing member 24 is inserted. Sealing member 24 is a solid tubular member having tapered ends 24' and 24" and is disposed a short distance from end 20 of body 12. A fluid tight seal is created by an interference fit between sealing member 24 and main body 12. A pressurized medium such as nitrogen gas 26 is disposed in body 12 between ink 14 and sealing member 24. The gas is pressurized to maintain a constant and continuous pressure on ink 14 such that ink 14 continuously and evenly flows through writing tip 19. Alternatively, a gas forming means, such as that set forth in U.S. Pat. No. 3,130,711 and incorporated by reference herein, may be located in the main body to continually produce a gas as the ink is depleted to maintain pressure therein.

Sealing member 24 is typically fabricated of a polymeric material such as polyethylene. Sealing member 24 is inserted longitudinally under pressure within body 12 and is radially contiguous with interior wall 13. However, with sealing member 24 alone, as in the prior art, it can be difficult to provide a hermetic seal between sealing member 24 and interior wall 13 due to the variations in the surfaces of member 24 and interior wall 13. Additionally, the method of insertion of member 24 into body 12 against interior wall 13 is limited due to the presence of gas in body 12. Methods such as welding or solvent bonding are undesirable due to the potential of interaction or leakage of gas during the process. In particular, if welding was used to bond the primary seal within body 12, the gas present therein would puncture holes in the bond formed between the two surfaces.

In order to provide a secure sealing system according to the present invention, a second or secondary sealing member 28 is inserted into end 20 and bonded or welded thereto in a fluid tight manner proximate first sealing member 24. It is preferable that sealing member 28 not be in contact with sealing member 24 so that all of the welding or bonding energy is transferred to the seal between sealing member 28 and interior wall 13 of body 12, and not divided between the bond formed between sealing member 28 and interior wall 13 of body 12 and a bond formed between primary seal 24 and secondary seal 28. Preferably, the clearance between sealing member 24 and sealing member 28 in an average writing instrument is at a distance of approximately 0.5 to 1.0 mm although this range is not a limitation on the distance therebetween which may vary depending on the size and shape of the device.

Interior way 13 at end 20 has a stepped section 21 whereby the diameter of interior way 13 is larger at this point with respect to the remaining interior. Sealing member 28 is preferably shaped in the form of a plug or button having a stem 30 thereon such that a first end of member 28 defining stem 30 fits within body 12. Stem 30 is tapered at the end thereof and provided to direct and maintain member 28 in body 12 during the insertion process. As shown, stem 30 does not contact interior wall 13 although this is by no means a limitation thereto and contact with wall 13 may or may not exist.

A second end 32 of member 28 defines a button portion having a first button section 32' which is radially contiguous with stepped section 21 of interior wall 13of body 12. A second button section 32" of slightly larger diameter than section 32' abuts second end 20 and is flush with the exterior surface 29 of body 12. Sealing member 28 may be welded or bonded to body 12. It is preferable that sealing member 28 be ultrasonically or kinetically welded to body 12 to provide a tight leak-proof seal. Sealing member 28 is typically fabricated of a rigid polymer or plastic material such as nylon, acrylonitrile, butadiene, styrene terpolymer, or the like although the shape and material of sealing member 24 is not limited to the specific shape and material mentioned. It is preferable that sealing member 28 be fabricated of the same material as body 12 such that the surfaces of body 12 and sealing member 28 meld into one component. The combination of sealing members 24 and 28 provides a double sealing system against the leakage of gas out of body 12.

The writing device of the present invention may be constructed by providing main body 12 having first end 16, second end 20 and interior wall 13. Ink 14 and gas 26 are inserted into main body 12 under pressure. Primary sealing member 24 is inserted under pressure into interior 13 immediately thereafter. Secondary sealing member 28 is inserted into second end 20 of main body 12 and sealed to the interior surface of main body 12 by welding or bonding (such as by solvent bonding).

As will be readily appreciated, the present invention provides one with a novel pressurized writing device which maintains constant pressure within the main body thereof and results in a steady flow of the writing medium when the device is in contact with writing paper or like means. Leakage of gas is prevented or reduced due to the combination of the primary and secondary sealing members While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the in the appended claims.

We claim:

1. A writing device comprising:

a main body having first and second ends;

a writing medium in said main body;

an application point positioned adjacent said first end of said main body;

a pressurized medium located in said main body and acting on said writing medium;

a first sealing member disposed in said main body near said second end of said main body; and a second sealing member inserted in said second end of said main body;

wherein said first and second sealing members are spaced apart from each other and formed such that gas does not pass therethrough.

2. The writing device of claim 1, wherein said first sealing member creates a fluid tight interference fit within said main body and said second sealing member is bonded in said second end in a fluid tight manner.

3. The writing device of claim 1, wherein said main body is cylindrical in shape and said first end of said main body is tapered to support said application point therein.

4. The writing device of claim 1, wherein said pressurized medium is present between said writing medium and said first sealing member.

5. The writing device of claim 4, wherein said first sealing member is solid such that gas cannot pass therethrough and said second sealing member is sealed to said second end of said main body such that gas cannot pass therethrough.

6. The writing device of claim 1, wherein said first sealing member comprises a middle tubular section and a pair of tapered ends.

7. The writing device of claim 6, wherein said main body has an interior surface and said tubular section is radially contiguous with said interior surface of said main body.

8. The writing device of claim 1, wherein said second sealing member comprises a stem section and a button section.

9. The writing device of claim 1, being an independent writing instrument.

10. The writing device of claim 1, being a cartridge which may be inserted into a writing holder.

11. A writing device comprising:

a main body having first and second ends;

a writing medium in said main body;

an application point positioned adjacent said first end of said main body;

a pressurized medium located in said main body acting on said writing medium;

a first sealing member disposed in said main body near said second end of said main body wherein said first sealing member creates a fluid tight interference fit within said main body; and a second sealing member spaced from said first sealing means in a direction toward said second end of said main body and sealed to said second end of said main body to assure against leakage of gas out of said main body.

12. The writing device of claim 11, wherein said second sealing member is welded to said main body.

13. The writing device of claim 11, wherein said second sealing member is solvent bonded to said main body.

14. A method of providing a pressurized writing device comprising the steps of:

providing a main body having a first end, a second end and an interior capable of holding ink therein and having an application point located on the first end thereof;

inserting ink into the main body;

inserting a gas under pressure into the main body following the ink and inserting a primary sealing member into the main body immediately thereafter, wherein first sealing member creates a fluid tight interference fit with the main body;

inserting a secondary sealing member into the second end of the main body;

welding the secondary sealing member to the surface of the main body.

15. The writing device of claim 1, wherein said first sealing member creates a fluid tight interference fit within said main body and said second sealing member is welded to said second end to create a fluid tight seal.

* * * * *